United States Patent [19]

Berg et al.

[11] 4,204,884

[45] May 27, 1980

[54] METHOD OF CONDITIONING CAST STEEL FOR HOT WORKING

[75] Inventors: Erik E. Berg, Stockholm; Rolf Tingwall, Avesta, both of Sweden

[73] Assignee: Ingersoll Steel Company, New Castle, Ind.

[21] Appl. No.: 21,270

[22] Filed: Mar. 15, 1979

Related U.S. Application Data

[63] Continuation of Ser. No. 932,713, Aug. 11, 1978, abandoned.

[51] Int. Cl.[2] ..... C21D 7/02

[52] U.S. Cl. ..... 148/2; 148/12 R; 148/12 E; 148/12 EA

[58] Field of Search ..... 148/2, 12 E, 12 R, 12 EA

[56] References Cited

U.S. PATENT DOCUMENTS

| | | | |
|---|---|---|---|
| 2,931,744 | 4/1960 | Samuels | 148/12 R |
| 3,285,789 | 11/1966 | Grange et al. | 148/12 R |
| 3,340,048 | 9/1967 | Floreen | 148/12 E |
| 3,347,715 | 10/1967 | Pfeil | 148/12 E |
| 3,678,571 | 7/1972 | Schoffmann | 148/2 |
| 4,086,105 | 4/1978 | Mayrhofer et al. | 148/12 E |

*Primary Examiner*—R. Dean
*Assistant Examiner*—W. G. Saba
*Attorney, Agent, or Firm*—Brumbaugh, Graves, Donohue & Raymond

[57] ABSTRACT

Cast bodies of steel grades which do not undergo phase transformation upon heating for hot working, for example, the austenitic stainless steels, are conditioned to undergo recrystallization upon subsequent heating by cold working the body as the first step in making it into an intermediate product, such as a slab, plate, band or billet. Upon subsequent heating, the steel recrystallizes to a finer grain structure with substantially altered grain boundaries. Such recrystallization substantially reduces the incidence of surface defects and edge cracking during subsequent hot working.

9 Claims, 7 Drawing Figures

10% REDUCTION, SURFACE, HEATED TO 2300° FOR ROLLING

1 MM

AS CAST, SURFACE

AS CAST, CENTER

AS CAST, HEATED TO 2300° FOR ROLLING

1 MM

10% REDUCTION, SURFACE

10% REDUCTION, CENTER

10% REDUCTION, SURFACE. HEATED TO 2300° FOR ROLLING

10% REDUCTION, CENTER. HEATED TO 2300° FOR ROLLING

1 MM

METHOD OF CONDITIONING CAST STEEL FOR HOT WORKING

This is a continuation of application Ser. No. 932,713 filed Aug. 11, 1978; now abandoned.

BACKGROUND OF THE INVENTION

The present invention relates to the manufacture of grades of steel which do not undergo phase transformation when being heated for hot working and, in particular, to a method of conditioning cast bodies of such steels to recrystallize upon heating.

In the manufacture of steel as presently practiced commercially, the molten steel is first formed into a body by casting, for instance, as an ingot in an ingot mold, or as a slab or billet of uniform cross-section by continuous casting or by pressure casting. The cast body is then processed to an intermediate product, usually a slab, plate, band or billet, by hot working.

Solidification of the molten steel in an ingot mold, continuous casting mold or pressure casting mold begins next to the mold wall by the formation of a thin surface layer of small equiaxed grains, some of which form the nucleii for large columnar crystals or grains (dendrites), that grow in a direction opposite to that of the heat dissipation. Due to segregation, various impurities contained in the melt end up in parts of the solidified cast body which were the last to solidify, that is, long the grain boundaries. The grain boundaries in alloys are zones of weakness, sites for oxidation or other adverse effects upon heating in preparation for hot working and cracking resulting therefrom during hot working.

Most steel grades undergo phase transformations in the course of cooling down after casting and of being reheated for hot working. Each phase transformation has associated with it a recrystallization which usually results in the formation of a finer, stronger grain structure. The recrystallizations that occur during temperature changes in most steel grades greatly reduce the propensities for oxidation and other attacks along grain boundaries upon heating and for cracking during working that would exist if the initial grain structure of the cast body were not significantly reformed by phase transformation and resulting recrystallization.

Certain metals and alloys do not, however, exhibit such phase transformations upon undergoing temperature changes. An important class of steels having the characteristic of phase stability through the range of temperatures applicable to hot working is the AISI 300 series, the austenitic stainless steels. The austenitic stainless steels solidify predominently as ferrite, all or most of which (depending on the composition) undergoes a phase transformation into austenitie immediately below the solidification temperature range. The essentially austenitic structure inherits the coarse columnar grain configuration and remain stable (without any phase transformation or recrystallization) as the steel is further cooled down after casting or heated up for hot working. The lack of recrystallization of the austenitic stainless steels during cooling subsequent to solidification and heating for hot working means that the coarse grain structure of the initially cast material must undergo heating and initial working. The coarse grain structure is prone to oxidation and other attacks along the grain boundaries near the surfaces as the cast body is heated for hot working and is subject to cracking during working. Such cracks can show up as edge cracks and/or silvers in the hot-worked intermediate product.

The molybdenum-containing grades, such as AISI 316 and 317 and modifications thereof, appear to be particularly subject to damage in the initial hot working phase of the processing of the cast body. It is believed that heating of those grades prior to hot working results in preferential oxidation of molybdenum along the grain boundaries near the surface and, thus, causes a further weakening of those boundaries. In all grades of austenitic stainless steel the susceptibility to surface and edge defects due to intergranular cracking also appears to be increased by the presence of metallic and non-metallic contaminants along the grain boundaries.

Following the initial hot working of the cast product to produce the intermediate product, e.g., a slab, plate, band or billet, the intermediate product is ordinarily conditioned to remove scale and surface defects. That operation is costly and time-consuming and involves the loss of material; the greater the extent of defects arising from cracking and slivers, the greater the cost in time and loss of material in the conditioning operation. In some cases the conditioning step can disrupt production schedules and delay deliveries. From time to time, there may be so much material removed in conditioning that the desired end product cannot be made from the intermediate product; for example, a slab destined to be made into a certain size plate may lose so much weight in conditioning that it will have to be down sized to a smaller sized plate at a substantial loss.

One approach to improving the initial hot working properties of cast austenitic steel has been based on cold working in the form of shot blasting the surfaces of the cast body prior to the initial hot working. Shot blasting affects only a thin layer at the surface without any noticeable change in cross-sectional area, and penetration is not significant except with shot of sizes so large that the shot blasting equipment cannot endure it. The treatment is also very costly.

SUMMARY OF THE INVENTION

There is provided in accordance with the present invention, a method of conditioning a cast steel body to undergo recrystallization to a finer, stronger grain structure upon heating preparatory to hot working. The finer, stronger grain structure reduces the incidence of preferential attack along the grain boundaries upon heating for initial hot working and makes the steel mechanically stronger and better able, therefore, to withstand the deforming stresses imposed on it during hot working. The method thus reduces the incidence of surface and edge defects in the intermediate products. This means, in turn, a reduction in the costs, including costs attributable to lost material, of the conditioning of the intermediate product prior to subsequent working.

The invention is applicable in particular to steel grades which do not exhibit phase transformation below the solidification temperature range. By far the most commercially important of those grades are AISI 300 series. The method consists of a single step, namely, cold working the cast steel body, that is performed as the first step in converting the cast body to an intermediate product such as a slab, plate, band or billet to be conditioned and finished as a plate, sheet, strip, bar or rod product. The cold working is performed by exerting pressure on the steel body such that reductions of cross-sectional areas take place in the planes where the pressure is applied. At the same time, the body is elongated in a direction predominently perpendicular to those planes. The cold working deforms the crystals, and the energy thus stored as internal stresses in the steel structure triggers recrystallization upon heating for hot working. The cold working can be performed in a single stage (e.g. a single pass through a rolling mill) or several stages.

The planes along which pressure is applied in cold working may be of different orientations in different stages of a multi-stage cold-working step; in other words the body can be turned between stages to apply pressure along planes different from those in the previous stage or stages. For an example, a plate may be rolled in different directions in separate stages, or a billet can be turned 90° about its axis between stages.

The amount of cold working required to trigger recrystallization is conveniently expressed as the product of the individual reductions in cross-sectional area that occur in each stage of cold working, regardless of the orientations of the aforementioned planes (along which pressure is applied) relative to each other. The individual reduction in cross-sectional area is defined as the quotient of the areas after and before each stage of cold working. The product of these individual quotients is hereinafter referred to as the "cross-section quotient product".

Cold working that results in cross-section quotient products of from about 0.99 to about 0.75 produces the desired effect of triggering recrystallization, the preferred range being from about 0.975 to 0.90. Generally, cross-section quotient products at the high end of the broad range, 0.99 to 0.975, are somewhat less effective than those in the middle because the extent of recrystallization will be small; on the other hand, cold working resulting in cross-section quotient products in the low part of the range (say, below 0.90 or 0.85) are not likely to produce results better than those in the middle and are difficult to achieve because it becomes increasingly more difficult to cold work the material further as the extent of work hardening increases.

The cold working is usually most conveniently performed by cold rolling. Cold rolling can be carried out using a standard hot-rolling mill, preferably the same mill used in hot rolling the material to produce the intermediate product. This is an important advantage because it means that the invention can be practiced without any investment in special equipment.

It appears that the large columnar grains of the cast structure offer less resistance to deformation by the cold working than would a finer grained structure; the ease of cold working cast austenitic steel is surprising and unexpected and evidently results, in fact, from the very problem sought to be solved, that of the relatively weak, coarse-grained structure of the material as cast.

Upon heating the cold-worked product yielded by the method of the present invention to temperatures above about 1000° F., preferably to temperatures for hot rolling, the deformed and stressed coarse grain structure recrystallizes (without any hot working) to a finer, stronger grain structure. The zones of weakness, the grain boundaries, associated with the structure formed upon solidification in casting are reformed upon heating prior to hot working in a manner which inherently impedes grain attack and crack formation during heating and hot working.

DESCRIPTION OF AN EXAMPLE

FIGS. 1 to 7 are microphotos of cross sections of AISI 316 stainless steel samples taken from pressure cast bodies. Preceding micro examination, all samples were heat treated (sensitized) at 1200° F. for 24 hours in order to make the grain boundaries visible by means of chromium carbide precipitation and subsequent attack by electrolytic etching in oxalic acid.

All samples were etched using a solution of 10 g oxalic acid in 100 ml water at 3–5 volts. The magnification was 60× for all photos.

An identical sample heated to 2300° F. showed the same structure.

Figure 1:
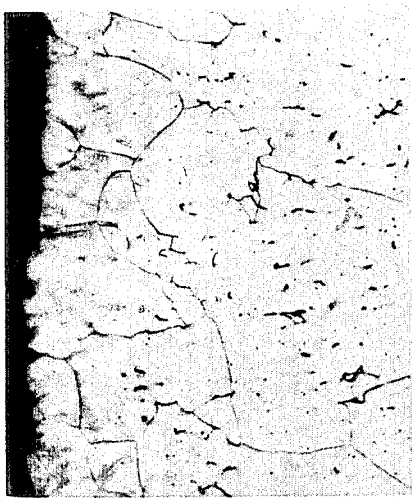
FIG. 1 shows the surface portion of a cast slab. The comparatively small grains at the very surface (at left) develop into larger columnar grains (at right).
Figure 2:
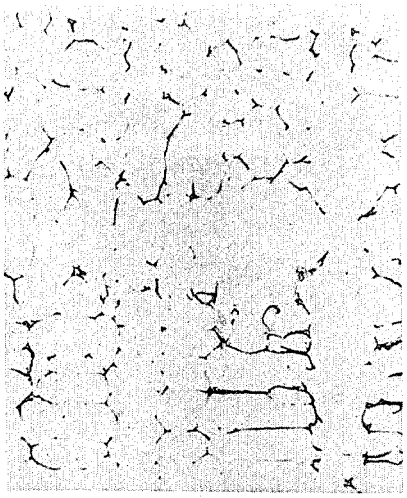
FIG. 2 shows the structure at the center of the slab (away from the surface). The dendritic structure formed at solidification remains, and any of the carbides formed at the sensitizing treatment have precipitated without any change of the dendrite pattern.
Figure 3:
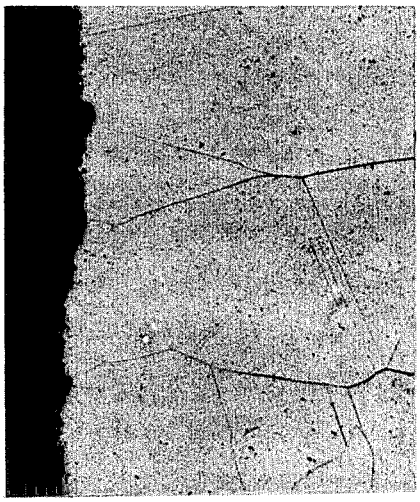

FIG. 3 illustrates what happens to the surface portion of the slab upon heating to 2300° F. for hot rolling. The large columnar grains formed upon solidification have in part assimilated the smaller grains at the surface. The large grains at the top and in the middle appear only in part, which means they must have lengths of at least 0.03 or 0.04 inches. The grain boundaries extend many thousandths inches in from the surface, indicating that intergranular cracking can occur to considerable lengths—perhaps 20 or 30 thousandths—along the long uninterrupted boundaries between the columnar grains; such long grain boundaries are sites for potential cracking upon working initiated at the surface and propagated many thousandths along the grain boundaries.

Figure 4:
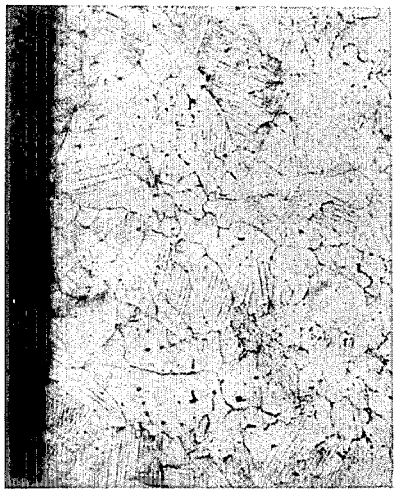

FIG. 4 shows the structure near the surface of a sample taken from a pressure-cast body that has been cold rolled according to the invention to a cross-section quotient product of 0.90. The sensitizing treatment at 1200° F. has triggered a complete recrystallization to a structure with extremely fine grains, with lengths in the order of 2 to 4 thousandths.

Figure 5:
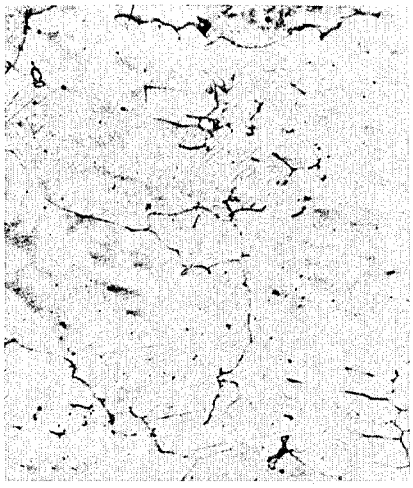

FIG. 5 confirms that the center portion of a cold-worked slab with a cross-section quotient product of about 0.90 also starts to recrystallize upon the sensitizing treatment at 1200° F.

Figure 6:
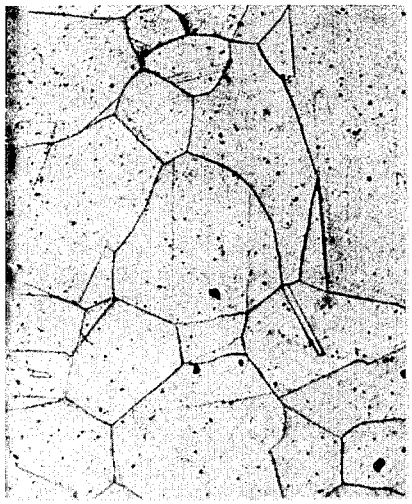
Figure 7:
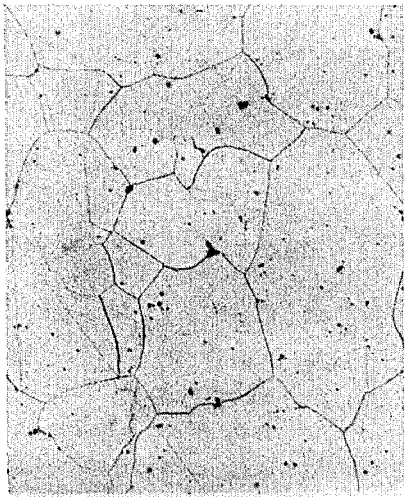

FIGS. 6 and 7 show the influence of heating a cold-rolled slab to 2300° F. for hot rolling. In the case of FIG. 6, the grain structure shown in FIG. 4 has undergone grain growth, but grain and grain boundary configuration have changed significantly from the structure in FIG. 3 where no cold rolling has taken place. FIG. 7 illustrates the completion of the recrystallization in the center of the slab upon heating for hot working (compare FIG. 5).

In the usual commercial manufacture of products from steel castings of uniform cross section, such as continuous cast or pressure cast bodies, pieces of a size adequate to yield the final product are cut from the cast body. After removal of loose scale and major surface defects, the pieces are subjected to initial hot working, in most cases by hot rolling. The intermediate product of the initial hot working is usually conditioned to remove scale and defects. Edge cracks may show up in the initial hot rolling. Substantial losses of material can occur in surface grinding and trimming of edge cracks.

The invention yields remarkable and unexpected results in reducing the incidence of edge and surface defects by triggering recrystallization of the cast material when it is heated for hot working. The sample shown in FIG. 6 is typical of the recrystallized structure and is characterized by generally much smaller, more regular shaped grains and generally more irregular and interrupted grain boundaries. The finger grain structure is less subject to attack during heating prior to hot working and less subject to cracking during hot working. It is known that steel having a relatively finer grain structure and irregular grain boundaries is less prone to cracking during initial hot working.

EXAMPLE

The following example is representative of the practice of the invention to best advantage.

A pressure-cast slab of Type 316L stainless steel measuring 5"×32"×50" and weighing 2234 pounds was analyzed to have the following composition:

| Element | % (by weight) |
|---|---|
| Chromium | 16.85 |
| Nickel | 12.21 |
| Molybdenum | 2.14 |
| Carbon | 0.025 |
| Silicon | 0.61 |
| Manganese | 1.73 |
| Nitrogen | 0.044 |

The slab was preconditioned to remove loose scale and major surface defects and then cold rolled at ambient temperature in a two-high plate mill having steel rolls 84 inches long and 34 inches in diameter driven at 30 r.p.m. The slab was reduced to 4.5 in. (i.e., by about 10%) thickness by four passes through the rolls of the mill, each pass producing approximately a 0.125 in. reduction in thickness and all passes being substantially lengthwise and producing only negligible changes in width.

The cross-section quotient product is calculated as follows. Because the slab is of substantially uniform cross-section along its length, the width need not be included in the computations for this example. Recalling from the above description that the cross-section quotient at each stage of cold working is equal to the area after divided by the area before the stage and the cross-section quotient product is the product of the quotients for all stages of the cold-working step, the thicknesses (which are proportional to the areas) are:

| Stage | Before | Reduction (less) | After |
|---|---|---|---|
| 1st | 5.00" | 0.125" | 4.875" |
| 2nd | 4.875" | 0.125" | 4.750" |
| 3rd | 4.750" | 0.125" | 4.625" |
| 4th | 4.625" | 0.125" | 4.500" |

and, therefore, the quotient product equals $$\frac{4.875}{5.00} \times \frac{4.750}{4.875} \times \frac{4.625}{4.750} \times \frac{4.50}{4.625}$$

which equals 0.90.

The slab was thereafter processed in the conventional manner to an intermediate plate 75"×98¾"×0.950" by heating in a pushthrough furnace to 2300° F. and hot rolling in the same two-high mill. The intermediate product was descaled, inspected and conditioned to remove surface defects and, finally, hot rolled and trimmed to a plate 96"×240"×0.250". The intermediate product (the 0.950" plate) exhibited a low level of surface and edge defects and required only moderate spot grinding to condition the surfaces.

The method of the present invention has no discernible effect on the grain structure or mechanical and physical properties of the final product. However, the invention ensures production essentially and predictably of intermediate products (normally, slabs, plates, bands or billets) that have a minimum of surface and edge defects after the initial hot working and minimizes the amount of conditioning required before final working. No capital investment is required for the method, and operating costs to carry it out are more than offset by the savings in reduced conditioning costs, reduced material losses in conditioning and trimming, and adherence to production and delivery schedules.

We claim:

1. A method of conditioning a cast steel body to undergo recrystallization upon heating to reduce the tendency for surface defects and edge-cracking upon hot working, the steel being of a grade which does not exhibit phase transformation when heated for hot working, comprising the step of cold rolling the body to an extent such that the cross-section quotient product after cold rolling is from about 0.99 to about 0.75; such step being performed on the body as the first step in converting it to an intermediate slab, plate, band or billet without prior treatment other than initial removal of scale and surface defects.

2. A method according to claim 1 wherein the cast body has a substantially uniform cross section.

3. A method according to claim 1 or 2 wherein the cross-section quotient product is from about 0.975 to about 0.90.

4. A method according to claim 1 wherein the body is cold rolled by at least one pass through a hot rolling mill.

5. A method according to claim 4 wherein the hot rolling mill is the same one as the body is later to be hot rolled in.

6. A method according to claim 1 wherein the steel of the body is an austenitic stainless steel.

7. A method of conditioning a cast body of austenitic stainless steel to undergo recrystallization upon subsequent heating to reduce the tendency for surface defects and edge-cracking upon hot working, consisting of the step of cold rolling the body by at least one pass through a rolling mill such that the cross-section quotient product is from about 0.975 to about 0.90, such step being performed as the first step in reducing the body to an intermediate slab, plate, band or billet without prior treatment other than initial removal of scale and surface defects.

8. A method of conditioning a cast steel body to reduce the tendency for surface defects and edge-cracking upon hot working, the steel being of a grade which does not exhibit phase transformation when heated for hot working, consisting of the step of cold rolling the body to cause recrystallization upon heating to a substantially finer and stronger grain structure with substantially altered grain boundaries, as compared to the grain structure in the body as cast, such step being carried out as the first step in reducing the body to a slab, plate, band or billet without prior treatment other than removal of scale and surface defects.

9. In a method of processing a cast body of a steel that does not exhibit phase transformation upon heating for hot working, the step of cold rolling the cast steel body such that the cross-section quotient product is from about 0.99 to about 0.75 to condition the body to undergo recrystallization during heating prior to subsequent hot working, thereby reducing the tendency for surface defects and edge-cracking upon hot working.

* * * * *